US006293124B1

(12) United States Patent
Roth et al.

(10) Patent No.: US 6,293,124 B1
(45) **Date of Patent: *Sep. 25, 2001**

(54) REFRIGERATED APPARATUS

(75) Inventors: Robin P. Roth; David E. Roth, both of Galloway; James D. Woltz, Columbus, all of OH (US)

(73) Assignee: DeLau Innovations, Ltd., Galloway, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/596,131

(22) Filed: Jun. 16, 2000

Related U.S. Application Data

(63) Continuation of application No. 09/544,702, filed on Jan. 7, 1998, which is a continuation of application No. 08/658,370, filed on Jun. 5, 1996, now Pat. No. 5,722,254.

(51) Int. Cl.[7] ..... F17C 13/00
(52) U.S. Cl. ..... 62/457.9; 62/458; 62/453
(58) Field of Search ..... 62/457.9, 451, 62/453, 458, 452, 440

(56) References Cited

U.S. PATENT DOCUMENTS

| | | | | |
|---|---|---|---|---|
| 2,337,622 | | 10/1943 | Tanner | 62/277 |
| 2,532,234 | | 11/1950 | Kimble | 62/457.9 |
| 2,654,231 | | 10/1953 | Eichhorn | 62/277 |
| 3,350,893 | | 11/1967 | Cable | 62/457.9 |
| 3,605,431 | | 9/1971 | Carson | 62/457.9 |
| 4,058,384 | | 11/1977 | Keefe | 62/457 |
| 4,220,197 | | 9/1980 | Schaefer et al. | 165/35 |
| 4,468,932 | | 9/1984 | Bullard | 62/421 |
| 5,228,309 | | 7/1993 | McCullough | 62/323.1 |
| 5,307,647 | | 5/1994 | McClure | 62/371 |
| 5,329,787 | | 7/1994 | Friday | 62/389 |
| 5,493,874 | | 2/1996 | Landgrebe | 62/457.2 |
| 5,718,124 | | 2/1998 | Senecal | 62/3.6 |
| 5,722,254 | * | 3/1998 | Roth et al. | 62/457.9 |

* cited by examiner

*Primary Examiner*—William Doerrler
(74) *Attorney, Agent, or Firm*—Standley & Gilcrest LLP

(57) ABSTRACT

A refrigerated serving device is disclosed. The refrigerated serving device is portable. It includes a food chilling area. A compressor is operatively connected to an evaporator coil and a condenser coil forming a refrigeration unit which maintains the food chilling area at a desired temperature.

4 Claims, 5 Drawing Sheets

REFRIGERATED APPARATUS

This application is a continuation of application Ser. No. 09/544,702, filed Jan. 7, 1998, which is a continuation of application Ser. No. 08/658,370, filed Jun. 5, 1996, now U.S. Pat. No. 5,722,254.

BACKGROUND OF THE INVENTION

This invention relates generally to serving devices and more particularly to a refrigerated serving device.

Maintaining food at the proper temperature when it is being served is very important. Food left at room temperature too long may spoil, resulting in wasted food. In addition, the food may cause illness in people who eat it.

Buffets and picnics are two situations in which it may be difficult to maintain food at the proper temperature. Keeping food hot is easily accomplished using warming trays. The warming trays can either be heated with flame or electricity.

The problem of keeping food properly cooled is not as easily solved. At a buffet, the refrigerated food is frequently placed on a table having ice on it. The food may either be placed directly in the ice, or the food containers may be surrounded by ice. This system has a number of shortcomings. The ice must be replenished when it melts. In addition, the water formed from the melted ice must be removed. Furthermore, if the ice or water spills on the floor, it can create a slipping hazard. Finally, the temperature of the food is not controlled. As the ice melts, the amount of contact between the ice and the food changes. This may allow the temperature of the food to increase to an unsafe level before the ice is replenished. Also, the food may become contaminated from contact with melting ice. The temperature of the food is not monitored to determine whether this is occurring.

Another problem associated with prior devices is the threat of contamination from several sources. The food may become contaminated with contact from melting ice used in some prior devices. The food can also become contaminated by food handlers responsible for replacing the ice. Furthermore, the water used to make the ice may have been contaminated. Also, prior devices are typically open air devices that do not protect the food from airborne pollutants/contaminants. And, even if noncontaminated ice were used, experts predict that the next environmental crisis will be a clean water shortage. The present invention overcomes these problems in that it does not rely upon ice for keeping the food cooled during serving and it incorporates a lid to reduce the chance of airborne contamination/pollution of the food.

Another solution to the problem of keeping food properly cooled during serving is to provide a double serving dish arrangement. The first serving dish is filled with water or another cooling material. The second dish is placed inside the first, and the bowls are placed into a freezer to freeze the water. Once the water is frozen, the food can be placed in the second dish. However when the ice melts, the dish loses its cooling ability, and the food must be placed in another dish.

In picnic situations, the refrigerated food is typically placed in a cooler containing ice. As the ice melts, the water formed can make the food soggy. In addition, once the ice melts, it must be replenished or the temperature of the food will quickly rise.

Standard refrigerators are not readily portable and are not suitable for use as a serving device. Movement of a standard refrigerator causes compressor fluid to move. This is why refrigerator manufacturers suggest letting a refrigerator sit still for several hours once moved, before operating it. In this manner the compressor is not damaged. The present invention, in its preferred embodiment using a screw or scroll compressor, is readily moved from place to place by one individual and does not have to sit for any period of time before being ready to operate.

Therefore, there is a need for a portable refrigerated serving device which does not require the use of ice to maintain the temperature of the food. The portable refrigerated serving device should be available in various sizes for use in the home as well as commercially for buffets, parties, and salad bars, for example.

DESCRIPTION OF THE INVENTION

Figure 1:
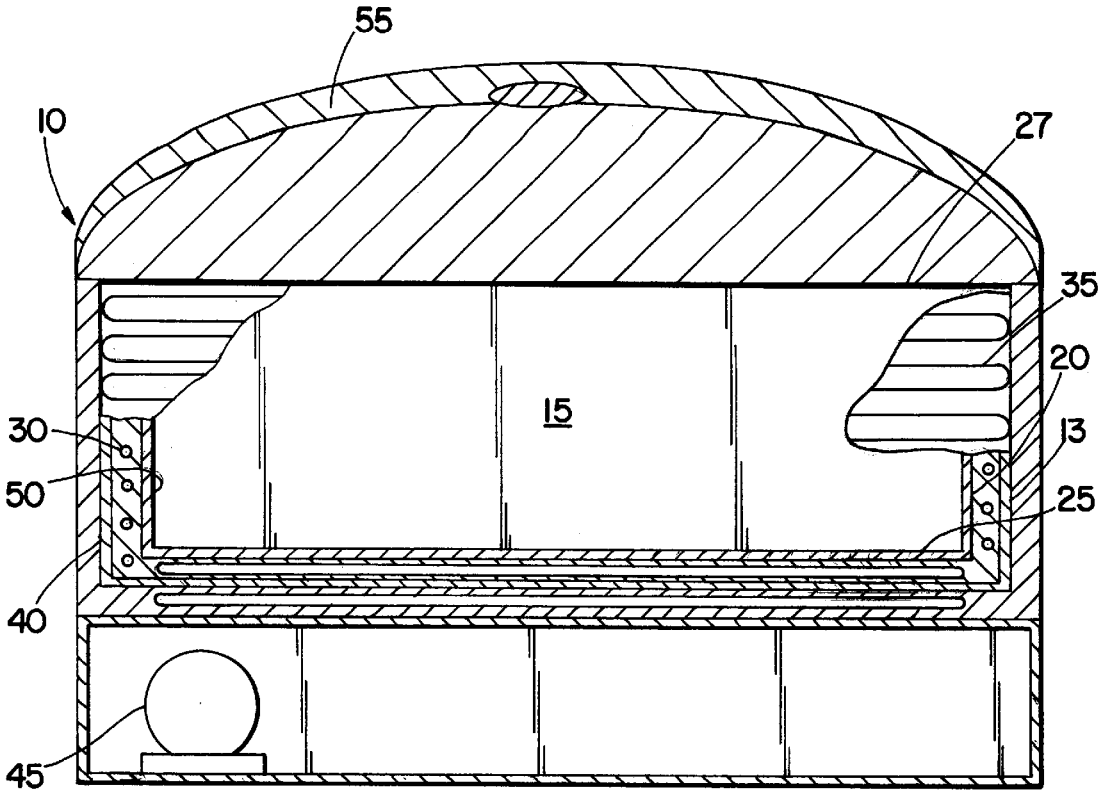
FIG. 1 is a cross-section view of one embodiment of the portable refrigerated serving device of the present invention.

Referring now to the drawings, the present invention, shown generally at 10, is a refrigerated serving device which has a food chilling area having a bottom, a plurality of sides (or of a round or oval configuration), and an accessible top opening. An evaporator coil is placed preferably adjacent to at least one side of the food chilling area. In a preferred embodiment there is a layer of insulation surrounding the sides and bottom of the food chilling area. A condenser coil is operatively connected with the evaporator coil and is preferably adjacent to at least one surface of the food chilling area. A compressor is operatively connected with the evaporator coil and the condenser coil forming a portable refrigerated serving device which maintains the food chilling area at a desired serving temperature, for example 38 degrees F.

The refrigerated serving device preferably has a controller for controlling the temperature of the food chilling area. It should have a lid over the top opening to maintain the cool temperature in the food chilling area. The lid is preferably hinged to the refrigerated serving device or is slidable therein and, when closed, covers the top opening of the food chilling area. The lid may be transparent.

The refrigerated serving device may also have a removable insert adapted to fit within the food chilling area thereby defining a food serving compartment. The removable insert may be of several different configurations, including one embodiment in which the insert has at least one divider. The compressor is preferably a screw compressor or a scroll compressor, or any other compressor of a design to enhance the device's portability.

The preferred embodiment of the invention is a portable refrigerated serving device. The device includes a portable housing with a food chilling area. The food chilling area in one preferred embodiment has a bottom and four sides.

FIG. 1 shows the portable refrigerated serving device 10. The refrigerated serving device has a housing 13. The food chilling area 15 is defined by four sides 20 and a bottom 25. The food chilling area has an accessible top opening 27. A continuous evaporator coil 30 is arranged preferably around two sides 20 and the bottom 25 of the food chilling area 15. The condenser coil 35 is arranged preferably around the remaining two sides 20 of the food chilling area 15. The condenser coil 35 is preferably separated from the evaporator coil 30 by a layer of insulation 40. The layer of insulation 40 preferably surrounds the food chilling area 15 on all four sides and the bottom. The condenser coil may form a part of the interior surface of the housing. A compressor 45 is operatively connected to the evaporator coil 30 and the condenser coil 35 in a manner known to those of ordinary skill in the art, to form a refrigeration unit. A removable insert 50 may be provided in the food chilling area 15, defining a food serving compartment. A lid 55 may be provided to cover the top opening 27. All of the above components should be selected with lightweight materials in mind.

Figure 2:
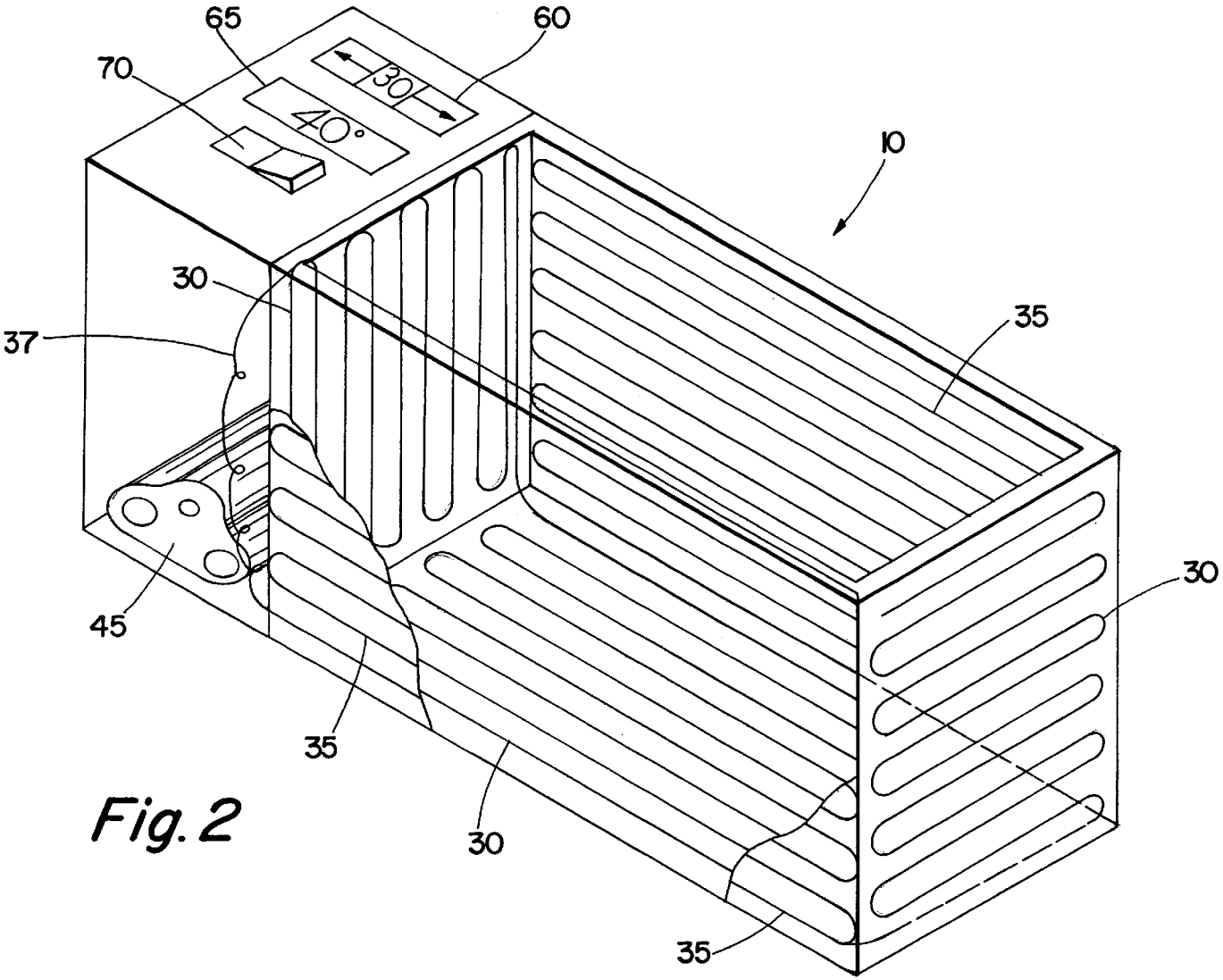
FIG. 2 is a perspective view of the arrangement of components of another embodiment of the refrigerated serving device of the present invention.

FIG. 2 shows the operating components of one embodiment of the present invention. The evaporator coil 30 is preferably arranged around the ends and bottom of the food chilling area. For example, the evaporator coil may be comprised of ¼ inch copper or aluminum refrigeration tubing. The condenser coil 35 may be arranged around the remaining two sides of the food chilling area and may be connected indirectly to the evaporator coil via a capillary tube 37. The condenser coil may be comprised of 5/16 inch copper or aluminum refrigeration tubing, for example.

The compressor 45 is operatively connected to the evaporator coil 30 and the condenser coil 35 forming a refrigeration unit. The present invention comprises a relatively small compressor to maintain its portability. A screw compressor is preferable in that it does not use a piston/cylinder arrangement to operate.

In the typical piston/cylinder arrangements compressor fluid or oil may tend to migrate into the cylinder when the portable unit is moved, causing operational delays or damage to the unit before the fluid settles properly. Reciprocating compressors must be stored upright. Otherwise, the oil and/or fluid can leak into the compressor cylinder and cause the failure of the compressor. With the portable refrigerated serving devices, a screw compressor is preferred since screw compressors do not have the oil/fluid leakage problem associated with piston/cylinder devices. A scroll compressor could also be used. A reciprocating compressor could be used in the portable device, but care must be taken to ensure that the refrigerated serving device is always maintained in an upright position.

Compressors are well known to those of ordinary skill in the art. A fan is not required for the refrigeration unit. Fewer moving parts is preferred.

The refrigerated serving device preferably has temperature controls 60 and 65. Control 60 allows the desired temperature to be set for refrigeration. Control 65 provides a readout of the actual temperature of the food chilling area. Any commercial controller having the appropriate temperature range could be used, such as controller number 1701-63 made by White-Rogers. The device may also have an on-off switch 70 to control the power to the refrigerated serving device.

Figure 3:
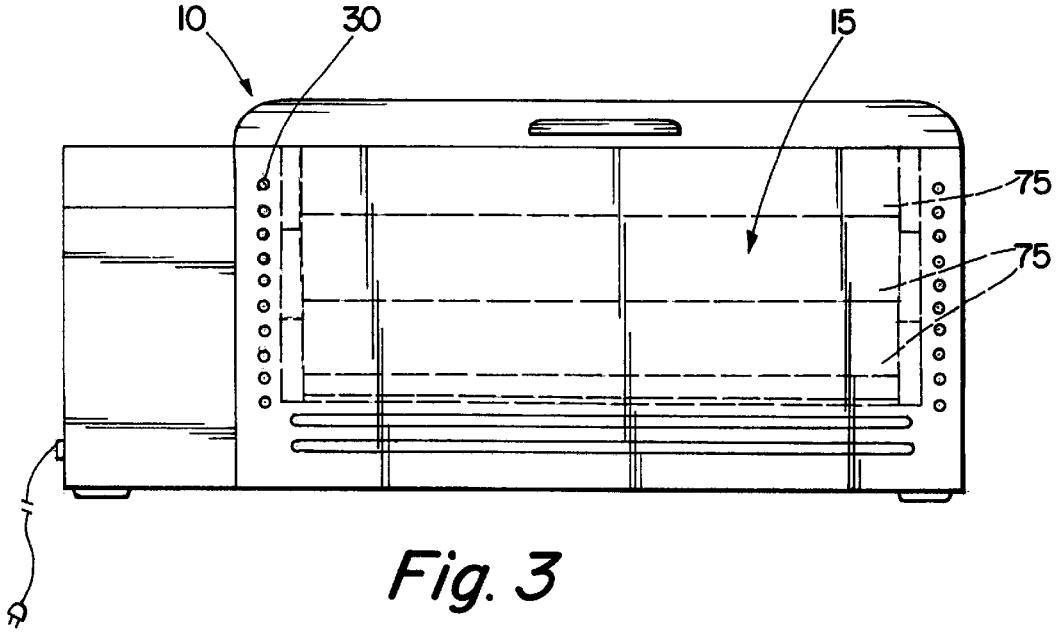
FIG. 3 is a side view showing another embodiment of the invention having removable, stackable trays.
Figure 4:
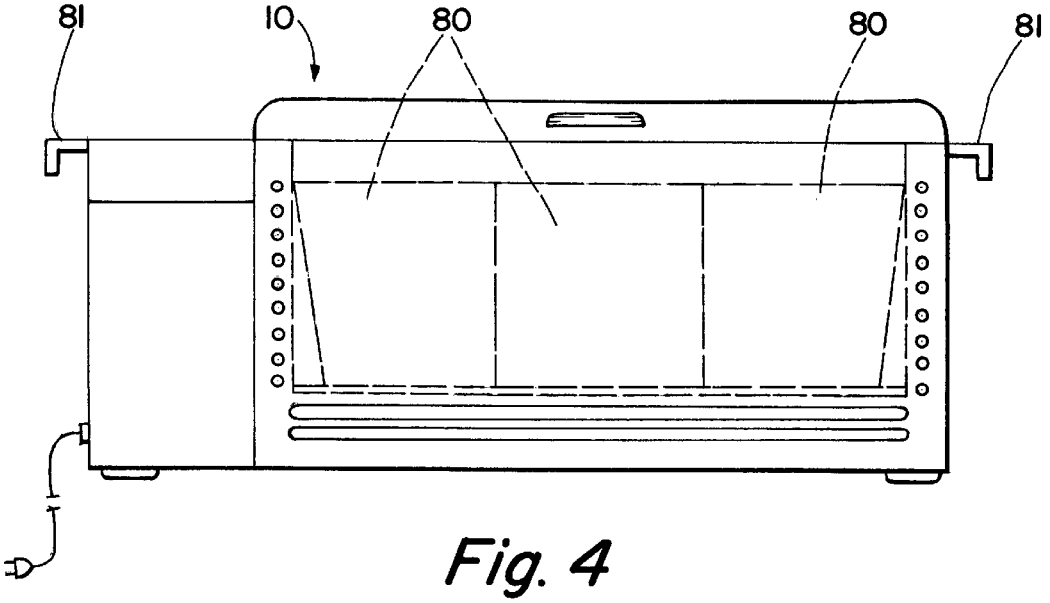
FIG. 4 is a side view showing yet another embodiment of the invention having a removable insert with three compartments.

FIGS. 3 and 4 show alternative removable inserts for the serving device. In FIG. 3, there are three trays 75 stacked in the food chilling area 15. In one particular application of the invention, different foods may be accessible at different stages, during an evening party for example, with the food on the top tray being accessed first, then that tray removed to access the food on the second tray down, and so forth. The chilling area 15, shown in FIG. 4, has an insert with three serving compartments 80. This allows different items to be placed in each compartment, such as cole slaw, macaroni salad, and potato salad. In FIG. 4, the three serving compartments 80 may be a one-piece compartmentalized unit, or each compartment could be made to stand alone with its own walls. The removable inserts may be made of any suitable material, with stainless steel or plastic being preferred. Handles 81 may be provided for enabling the device to be readily grasped and moved by an individual. The entire device should not weigh more than an adult woman can safely lift by herself (such weight being established by industrial safety standards for instance).

Figure 5:
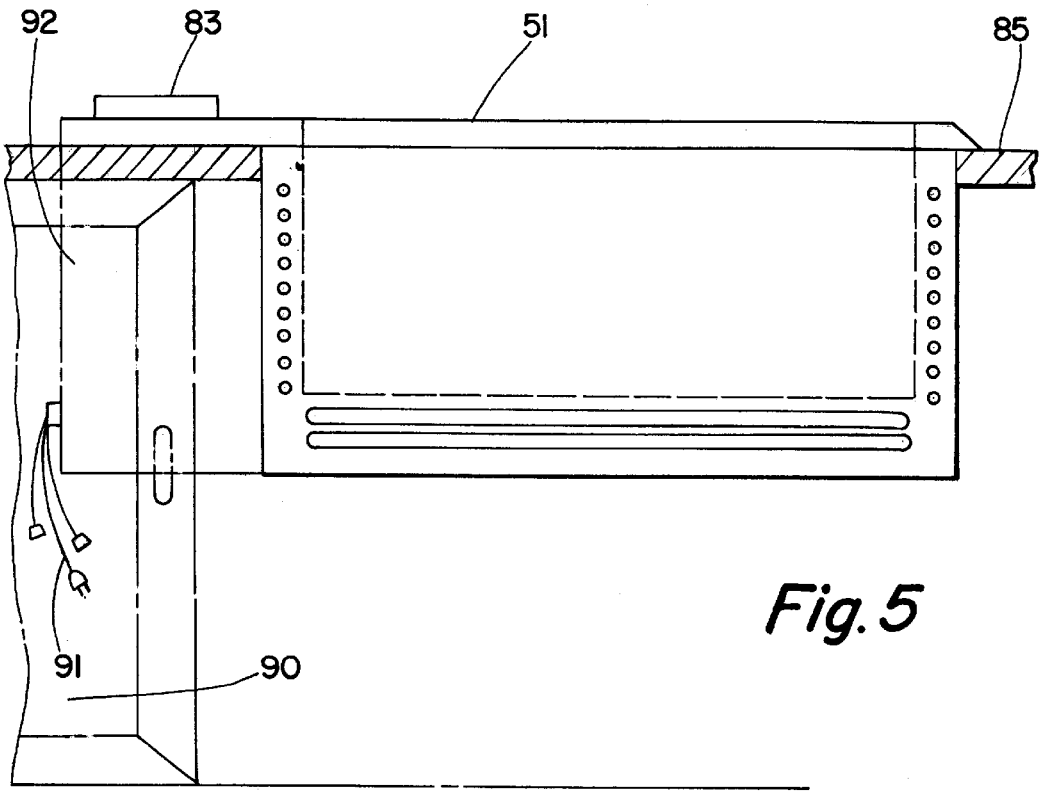
FIG. 5 is a cross-section view of a refrigerated serving device removably installed in a countertop.

FIG. 5 shows the refrigerated serving device recessed in a cabinet 90, such as an island in the kitchen of a home. The components, other than the controls 83, of the refrigerated serving device may be out of view in the cabinet. In this embodiment only the lid 51 is above the surface of the countertop 85. The power cord 91 is also recessed in the cabinet so that it is not visible on the countertop. In this embodiment the compressor 92 may remain attached to the serving device as described and shown above, or the compressor may be detached from the serving device and moved to the bottom of the cabinet if it is preferred to use the serving device in a more permanent way in the countertop.

Figure 6:
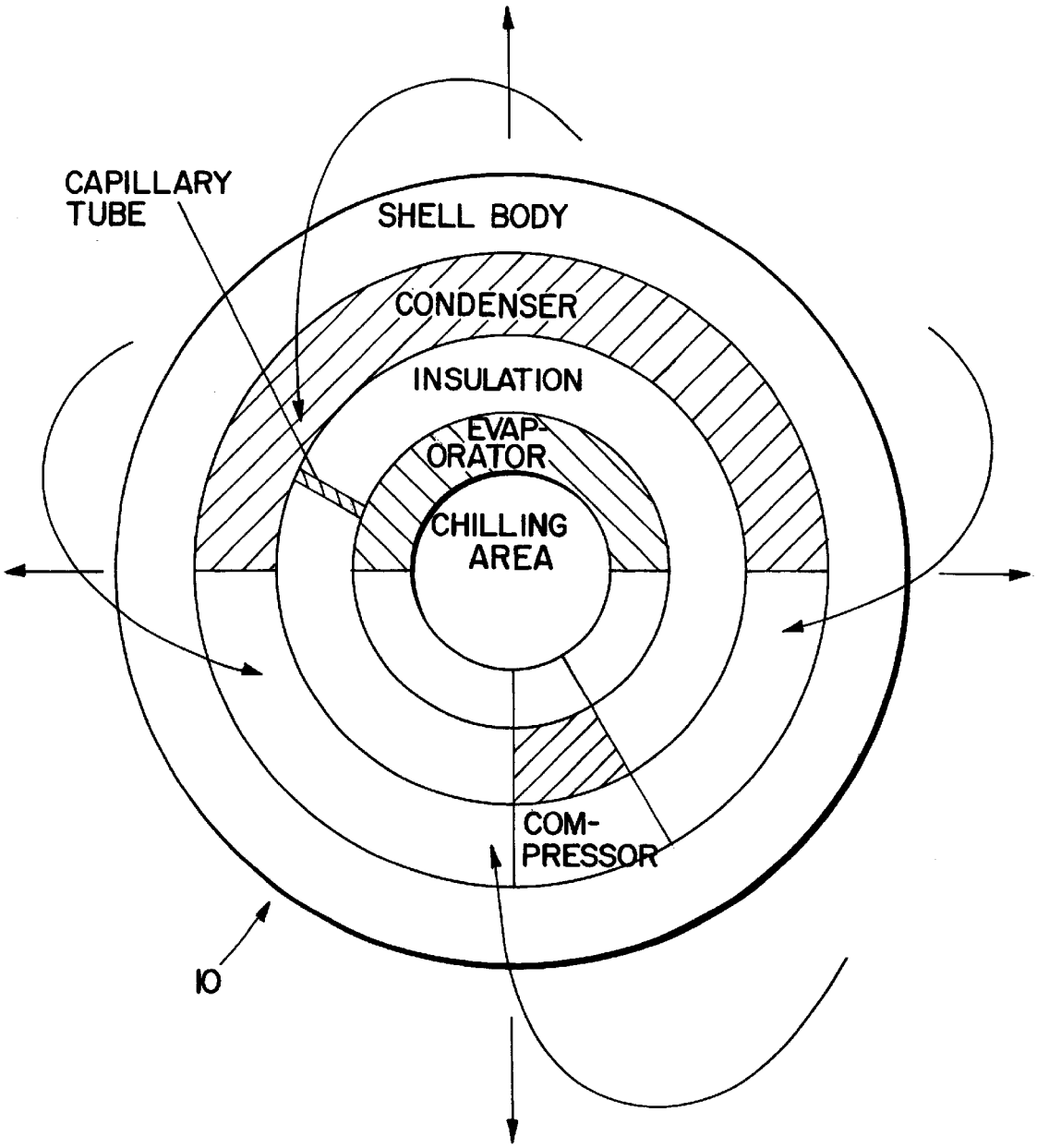
FIG. 6 is a schematic representation of the mechanical components of the present invention.

FIG. 6 shows a representation of the unique arrangement of components of the present invention and their physical relationship to adjacent components. FIG. 6 also reflects the portable or "movable" feature of the invention. The directional arrows show that the present invention may be moved in a variety of motions during transport and still be readily operational at its destination. When transporting food, such as in a catering business, the present invention will be packed into a vehicle and carried from the vehicle to the destination where the food will be served. During this process the present invention may encounter various movement and minor shocks and impacts.

Figure 7:
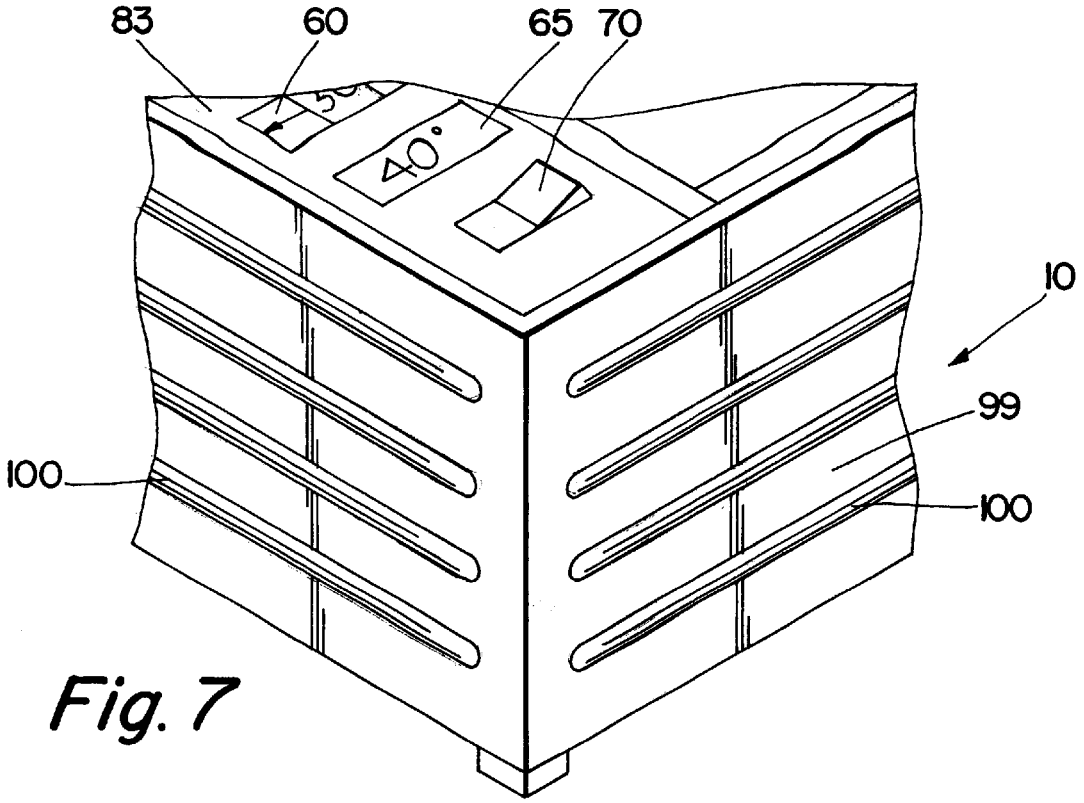
FIG. 7 shows one embodiment of the invention having a protective outer body.

FIG. 7 shows an embodiment in which a protective plastic shell 100 is secured to the outside of the server walls 99. The walls may be aluminum for better heat conduction purposes. The shell may be provided to prevent any substantial damage to the aluminum walls during transport.

Figure 8:
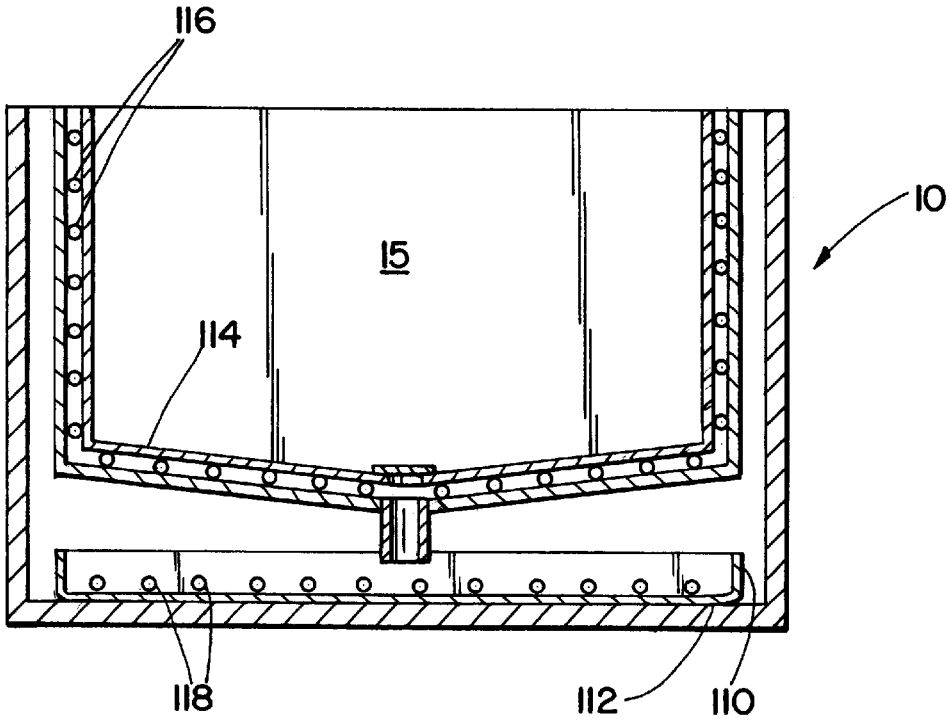
FIG. 8 shows a schematic representation of yet another embodiment of the invention having a drain pan and funnel configuration.

FIG. 8 shows yet another embodiment of the invention in which a drip pan 110 is installed within the housing 112 and the bottom surface 114 of the food chilling area 15 lies just above the drip pan. The bottom surface may be made to drain into the drip pan. The evaporator coils 116 preferably drain their condensate droplets to the drip pan. The condenser coils 118 may be configured to actually reside in the drip pan where the heat from the condenser coils would aid evaporation.

The present invention has been described in the form of preferred embodiments, but it is to be recognized that several modifications and variations to the invention could be made and fall within the scope of the claims.

What is claimed is:

1. An apparatus comprising:

a housing;

a chilling area within the housing having a bottom and a plurality of sides;

a heat absorbing element within the housing and adjacent to at least one side of the chilling area;

a layer of insulation surrounding the chilling area and said heat absorbing element;

a heat releasing element within the housing operatively connected with the heat absorbing element, the heat releasing element adjacent to at least one other side of the chilling area, the at least one other side being different from the at least one side next to which the heat absorbing element is located, the heat releasing element being separated from the chilling area and the heat absorbing element by the layer of insulation;

a device for moving a heat transferring agent through the heat absorbing element and the heat releasing element, to form a refrigeration unit.

2. A refrigerated apparatus, comprising:

a housing adapted to reside at least partially within a cabinet;

a chilling area within the housing having a bottom and a plurality of sides;

a heat absorbing element within the housing and adjacent to at least one side of the chilling area;

a layer of insulation surrounding the chilling area and said heat absorbing element;

a heat releasing element within the housing operatively connected with the heat absorbing element, the heat releasing element adjacent to at least one other side of the chilling area, the at least one other side being different from the at least one side next to which the heat absorbing element is located, the heat releasing element being separated from the chilling area and the heat absorbing element by the layer of insulation;

a device operatively connected to the heat absorbing element and the heat releasing element for moving a heat transferring agent through the heat absorbing element and the heat releasing element, to form a refrigeration unit.

3. The apparatus of claim 2, wherein said device is a compressor.

4. The apparatus of claim 3, wherein said compressor is placed apart from said housing and in said cabinet.

* * * * *